United States Patent [19]

Koenig

[11] 4,253,615

[45] Mar. 3, 1981

[54] PALLET AUGER

[76] Inventor: Larry E. Koenig, 1208 Medow Lane Dr., Bettendorf, Iowa 52722

[21] Appl. No.: 72,715

[22] Filed: Sep. 4, 1979

[51] Int. Cl.[3] ..... B02C 18/38

[52] U.S. Cl. ..... 241/36; 241/260.1

[58] Field of Search ..... 241/82.6, 28, 260.1, 241/261, 32, 36

[56] References Cited

U.S. PATENT DOCUMENTS

| | | | |
|---|---|---|---|
| 1,889,381 | 11/1932 | Rush | 241/260.1 X |
| 2,027,015 | 1/1936 | Bell | 241/260.1 X |
| 2,468,613 | 4/1949 | Bjorklund | 241/260.1 X |
| 4,034,918 | 7/1977 | Culbertson et al. | 241/36 |
| 4,040,571 | 8/1977 | Lindeborg | 241/36 X |
| 4,182,592 | 1/1980 | Henryson | 241/260.1 X |

*Primary Examiner*—Mark Rosenbaum

*Attorney, Agent, or Firm*—Henderson & Sturm

[57] ABSTRACT

In machines for handling waste material, a particular problem is effective pulverization and compacting of larger materials. A hopper (14) is mounted upon a frame (12) containing an auger (13). The frame (12) has a curved bottom (29) and an opening (36). An adjustable rim assembly (37) is disposed about the opening (36). The auger blade (43) has peripheral teeth (46). Breaker bar structures (31, 38) are disposed on the bottom (29) and about the opening (36). Interaction of the blade and teeth, breaker bars and rim cause efficient pulverization of larger waste materials.

4 Claims, 9 Drawing Figures

87
OL
98
M1
76a
76b
CR2
TR1
M2
TR2
TR3
CT1
133
CR1

93
103
104
CT1-2
92
102
REV
FWD
102a
102b
CR2-1
TR1-1
TR1-2
CR2-2
TR2-1
TR2-2
CR1-1
CR1-2
91
AUTO
MAN
OFF
101a
101b
TR2-1
TR3-1
TR3-2
CT1-1
CR1-3
CT1-1
OFF
ON
89
101
99
82
110
94
88
86
M1-1
105

PALLET AUGER

TECHNICAL FIELD AND BACKGROUND

The invention relates to material handling equipment. More particularly the invention relates to devices for grinding and compacting waste material.

Worm conveyor type augers have been developed. These are generally employed for handling paper and other light trash. Heavier materials such as bulky wood pieces are not handled by such machines.

Rotary or hammermill shredder units have been developed which are capable of handling heavier materials. However, these units run at relatively higher rates of speed and are more prone to wear and to break down.

DISCLOSURE OF THE INVENTION

The pallet auger of this invention includes a frame support assembly. Mounted upon the frame is a hopper assembly having access openings for feeding by hand, conveyor or dumper. An auger assembly is substantially supported and enclosed by the frame and includes a screw member which projects into an aperture formed in the side of the frame support assembly. A plurality of teeth structures are disposed along the edge of the screw. Breaker bar structures are disposed about the aperture and below the screw. A container assembly is disposed adjacent the frame and communicates with the aperture. Waste materials loaded into the hopper travel from there into the frame support. The auger assembly pulverizes and compacts the material and drives the material into the container.

It is a general object of this invention to provide for more effective handling of waste material, particularly larger, heavier wooden structures, such as pallets.

Another object of this invention is to facilitate recycling of waste material, thereby reducing waste disposal costs and land usage therefor.

Still another object of the invention is to effectively transform certain waste materials into a fuel for industrial and other usage, thereby resulting in cost and energy savings.

Also an object of this invention is the provision of a pallet auger which is less susceptible to wear, yet capable of achieving the aforementioned objects.

These objects and other features and advantages of this invention of a pallet auger will become more readily apparent upon referring to the following description, taken in conjunction with the appended drawing.

BRIEF DESCRIPTION OF THE DRAWING

The pallet auger of this invention is illustrated in the drawing wherein.

BEST MODE FOR CARRYING OUT THE INVENTION

Figure 1:
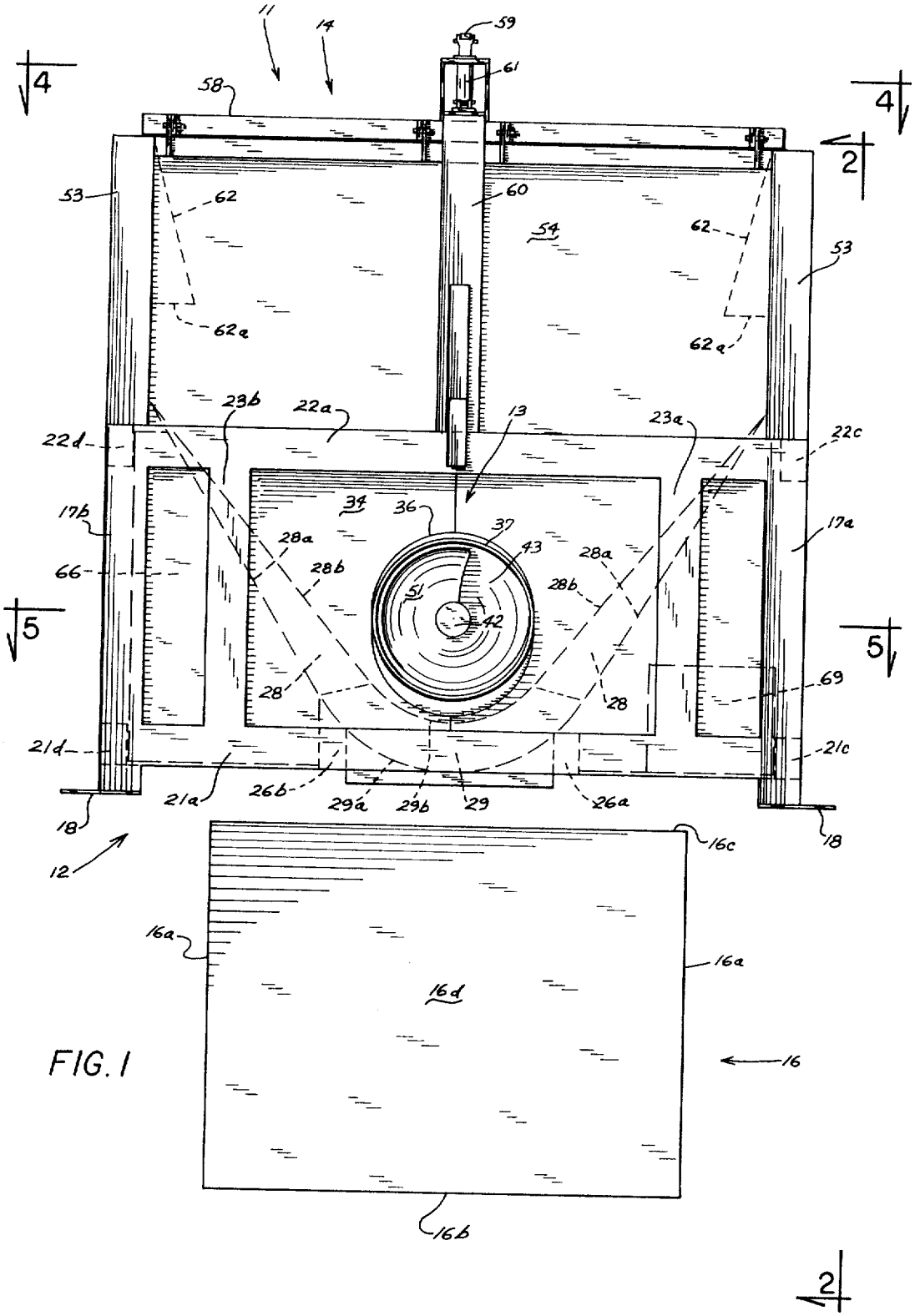
FIG. 1 is an elevational view showing the front end of the pallet auger, the container assembly being shown disposed away from the frame assembly.
Figure 2:
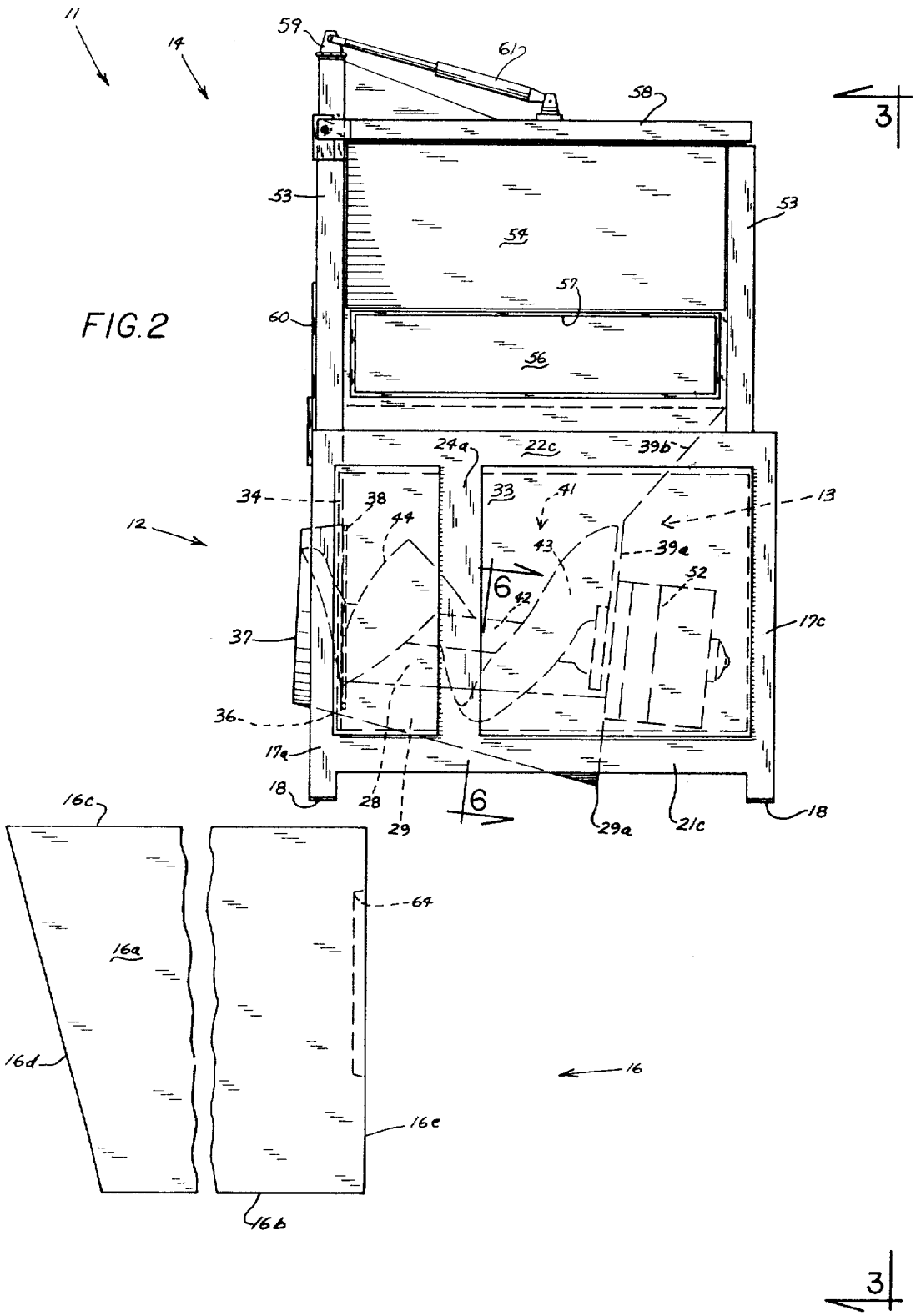
FIG. 2 is a right side elevational view of the pallet auger taken along line 2—2 of FIG. 1.
Figure 3:
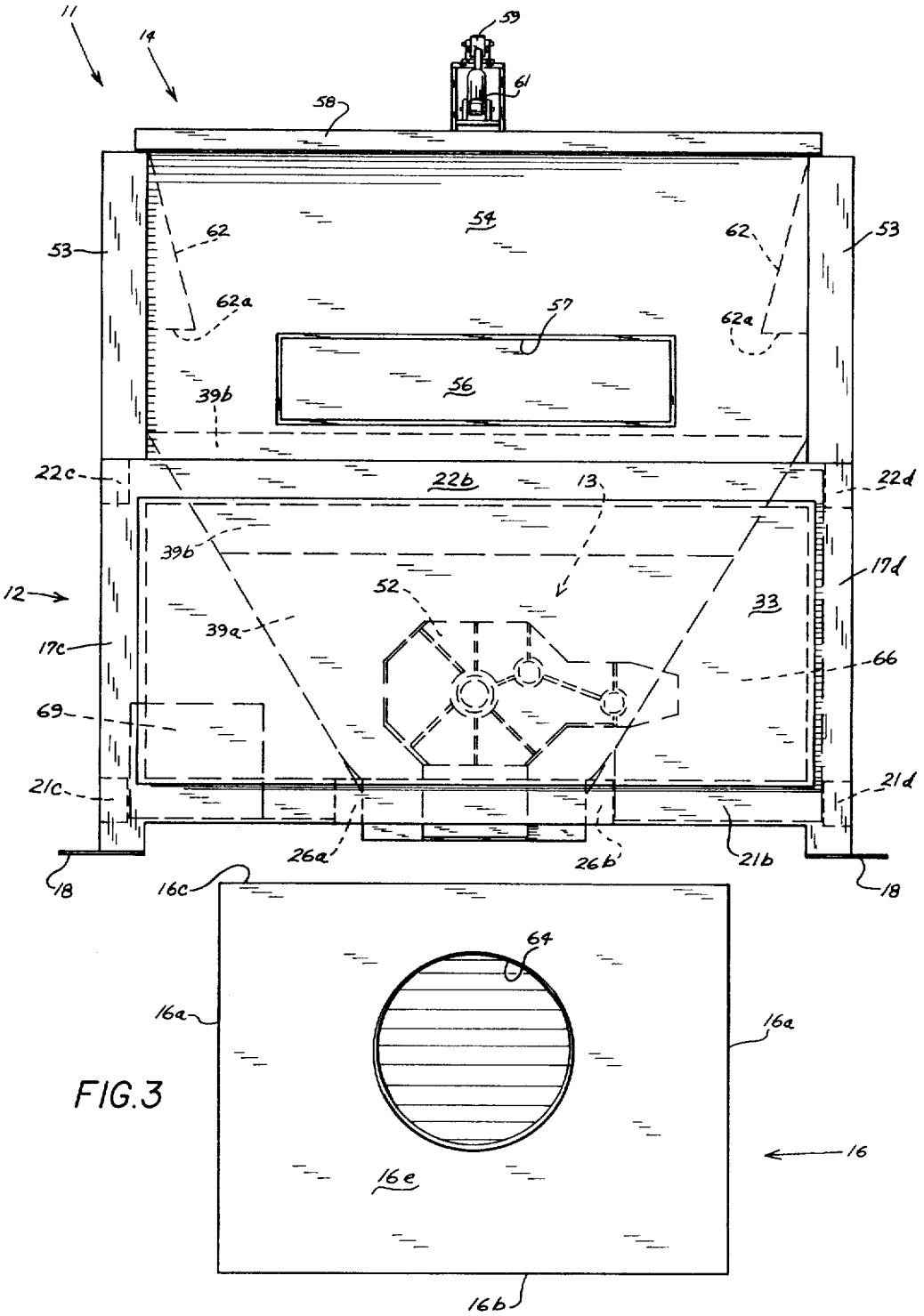
FIG. 3 is a rear elevational view of the pallet auger taken along line 3—3 of FIG. 2.
Figure 4:
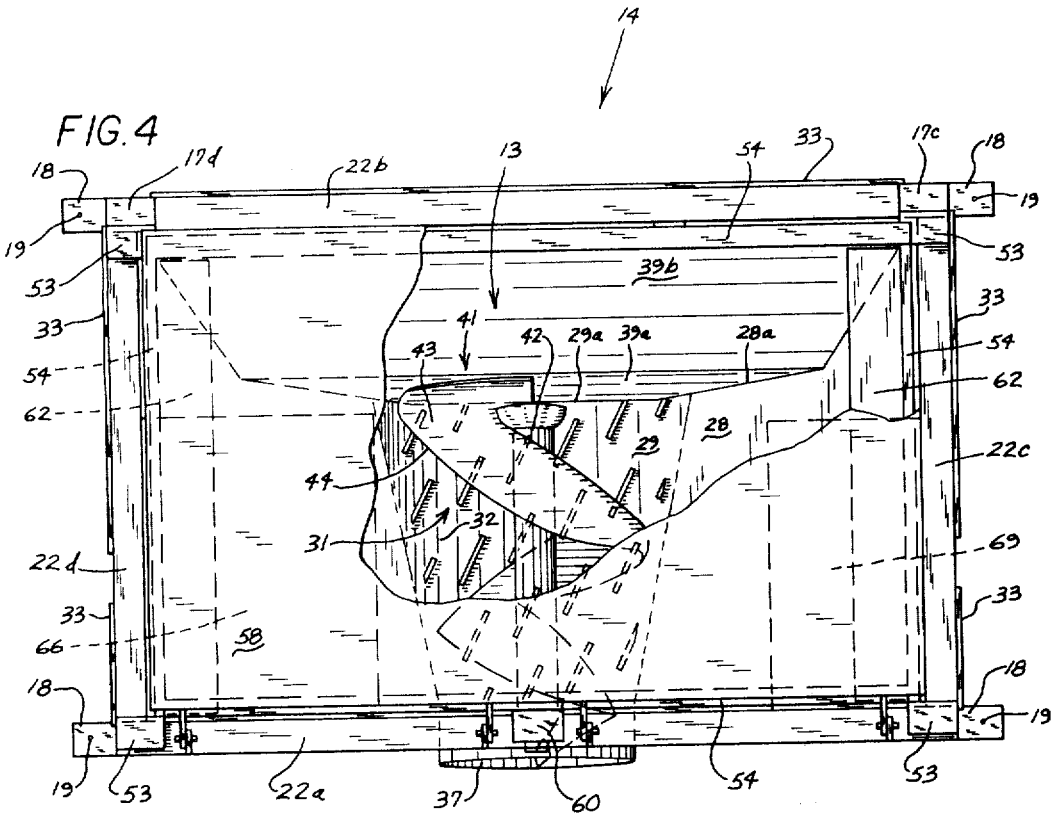
FIG. 4 is a top plan view taken along line 4—4 of FIG. 1, portions of the hopper assembly being cut away.
Figure 5:
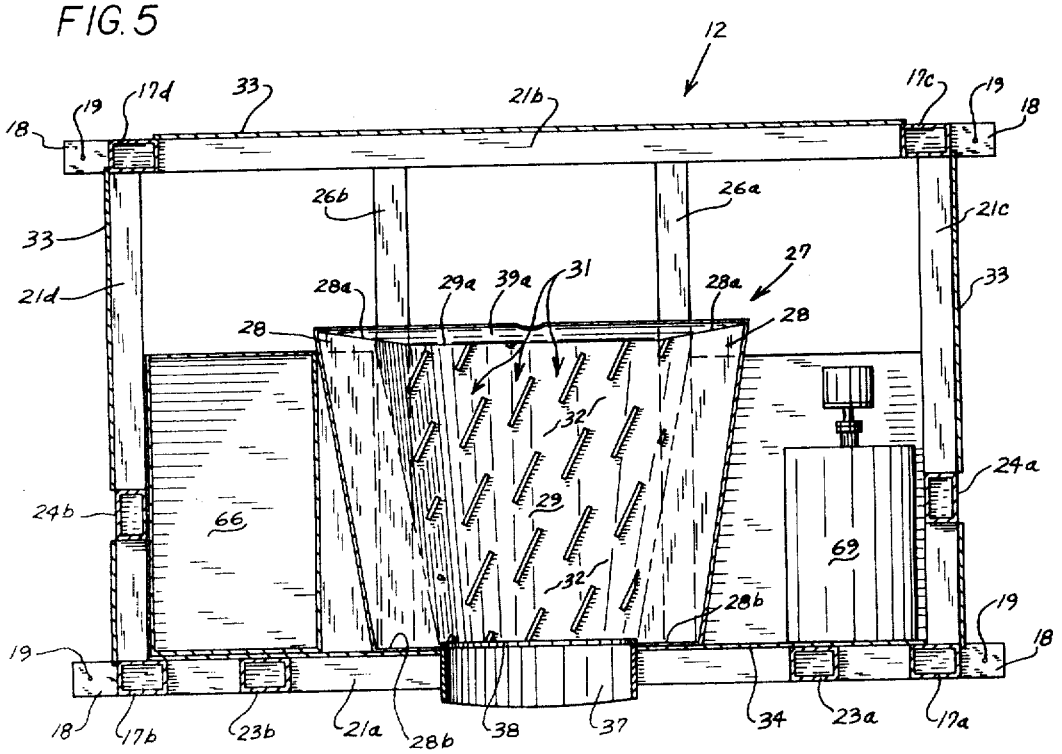
FIG. 5 is a horizontal cross-sectional view taken along line 5—5 of FIG. 1, portions of the auger assembly being removed for greater clarity.
Figure 6:
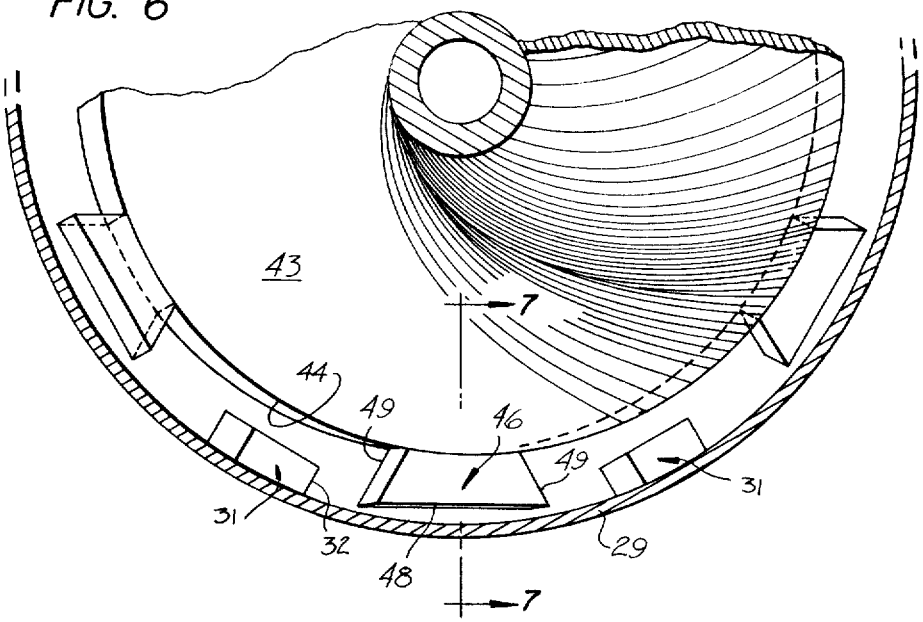
FIG. 6 is an enlarged, fragmentary transverse sectional view taken along lines 6—6 of FIG. 2.
Figure 7:
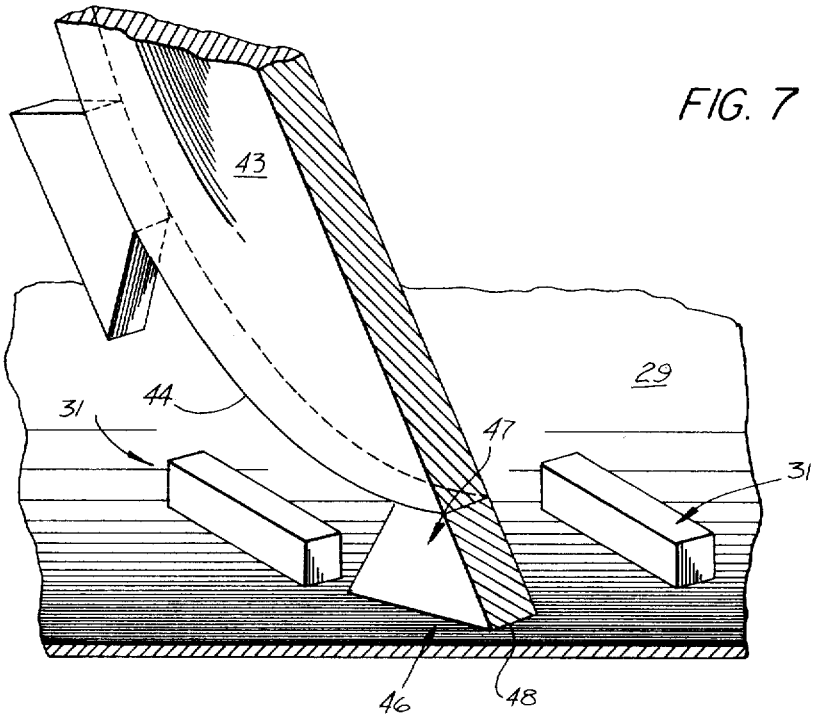
FIG. 7 is an enlarged fragmentary sectional view taken along line 7—7 of FIG. 6.
Figure 8:
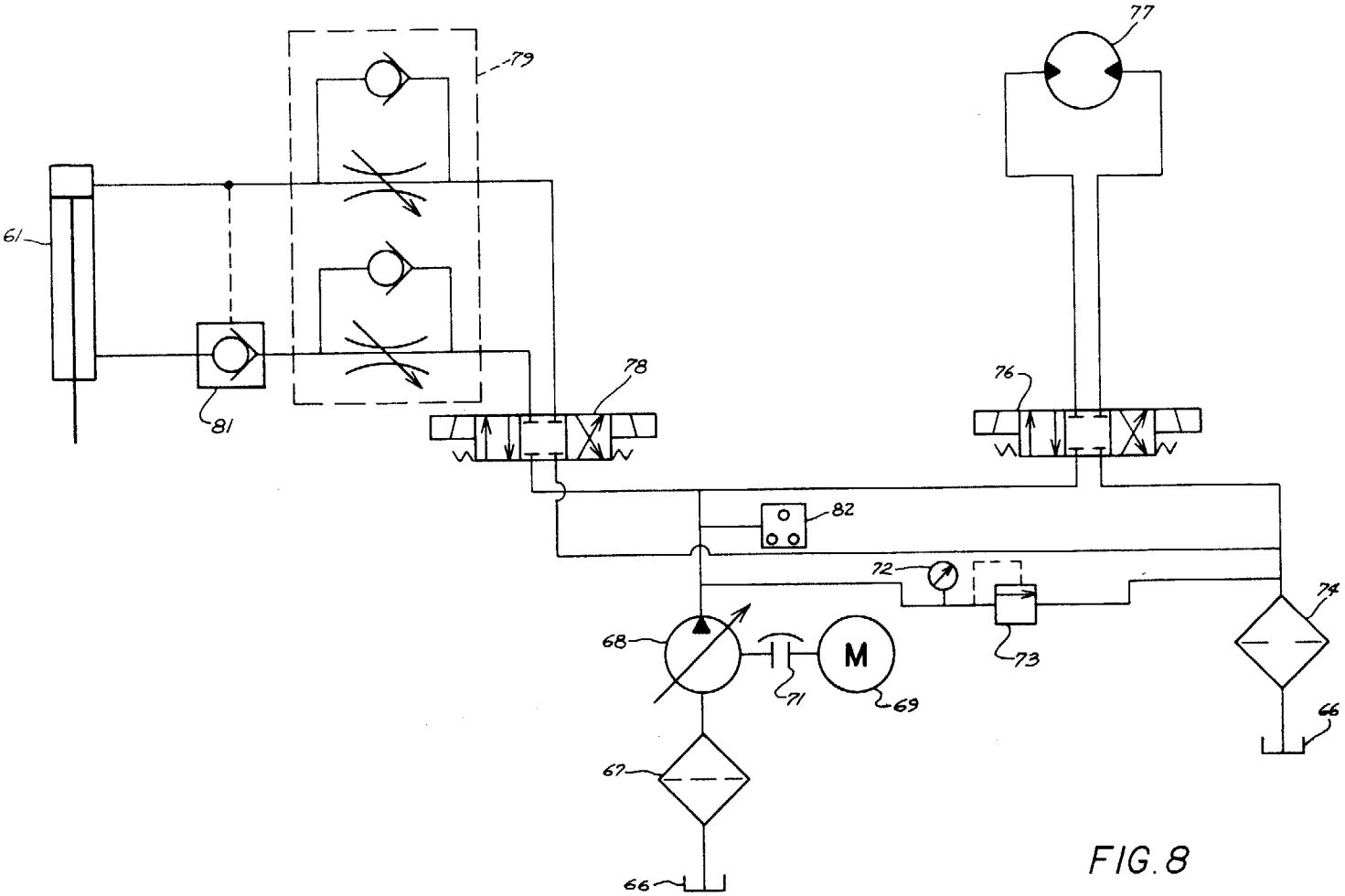
FIG. 8 is a schematic of the hydraulic control circuit.

The pallet auger of this invention is shown generally at 11 in the drawing. More particularly, the pallet auger 11 includes frame support, auger, hopper and container assemblies 12, 13, 14, 16.

The frame support assembly 12 includes right and left front and right and left rear, generally upright tube members 17*a*, 17*b*, 17*c*, 17*d*. A plate 18 is affixed normal to the longitudinal axis, and at the lower end, of each member 17*a*, 17*b*, 17*c*, 17*d*. The plates 18 engage the floor or ground, and apertures 19 are formed therethrough for receiving bolts or the like, such that the plates 18 may be held stationary with respect to the floor. Front, rear, right and left side, horizontal tube braces 21*a*, 21*b*, 21*c*, 21*d* extend between the lower portions of the members 17*a*, 17*b*, 17*c*, 17*d*, and front, rear, right and left side, horizontal tube braces 22*a*, 22*b*, 22*c*, 22*d* extend between the upper portions of the members 17*a*, 17*b*, 17*c*, 17*d*. The joined members 17*a*, 17*b*, 17*c*, 17*d* and braces 21*a*, 21*b*, 21*c*, 21*d*, 22*a*, 22*b*, 22*c*, 22*d* have a generally rectangular configuration.

Right and left channel member bumpers 23*a*, 23*b* are affixed between the lower tube brace 21*a* and upper brace 22*a*. Right and left tube braces 24*a*, 24*b* extend upwardly from the side braces 21*c*, 21*d* to the side braces 22*c*, 22*d*. A pair of spaced, intermediate support tubes 26*a*, 26*b* extend between the front and rear lower tube braces 21*a*, 21*b*.

A curved plate member 27 includes straight side portions 28 and a curved bottom portion 29. The bottom portion 29 connects the lower ends of the side portions 28 and is attached to the support tubes 26*a*, 26*b*. The side portions 28 extend upwardly from portion 29 and away from each other. As shown in FIG. 1, the rear edge 29*a* is disposed lower than the front edge 29*b*, the bottom portion 29 being generally upwardly inclined from rear to front. The rear edges 28*a* are spaced farther apart than are the front edges 28*b*, the side portions 28 being angled toward each other from rear to front. The plane defined by the edges 28*a*, 29*a* extends upwardly at an angle from front to rear. A plurality of spaced apart, elongated bar structures 31 are attached to the upper surface of the curved bottom portion 29. The bars 31 are generally rectangular in cross section. The bars 31 are disposed at an angle to the longitudinal axis of the portion 29 and extend generally from right rear to left front. A plurality of gaps 23 are formed in the bars 21.

A plurality of cover doors or mounting plates 33 attached to the members 17 and braces 21*b*, 21*c*, 21*d*, 22*b*, 22*c*, 22*d*, enclose the frame assembly 12. A unitary front cover plate 34 is attached to members 17*a*, 17*b*, braces 21*a*, 22*a* and bumpers 23*a*, 23*b* and has an aperture 36 formed therethrough. A rim assembly includes an annular member 37 of a selected longitudinal dimension attached to the outside surface of the front plate 34, around the aperture 36, and extends away from the frame assembly 12. Breaker bar structures 38, generally rectangular in cross section, are attached to the inside surface of the front plate 34 adjacent to and completely around the aperture 36.

The auger assembly 13 includes a support plate 39*a* which is attached to the support tubes 26*a*, 26*b* and to the rear edges 28*a*, 29*a* of the curved plate 27. A chute plate 39*b* is joined to the upper edge of plate 39*a* and extends upwardly therefrom and to the rear. An auger member 41 includes a shaft 42 extended through and rotatably supported by the plate 39*a*. The shaft 42 is normal to the plate 39*a*, and its longitudinal axis extends through the center of the aperture 36. The shaft 42 is rotatable about its longitudinal axis and has a screw blade 43 attached thereto. The shaft 42 and blade 43 extend from the plate 39*a*, through the aperture 36, into the space within the annular member 37. The blade 43 has a peripheral edge 44; and the distance of the edge 44 from the shaft 42 decreases from the rear to the front of the auger 41. Attached at the edge 44, uniformly spaced all along the length of the blade 43, are a plurality of teeth 46. A shorter, inside edge 47 of each tooth 46 is attached to the peripheral edge 44. Each tooth 46 terminates in a longer, extended edge 48 disposed away from the shaft 42 and blade 43. Each tooth 46 is as thick as the screw blade 43, the forward and rearwardly directed surfaces of the teeth 46 being flush with those of the blade 43 at the areas adjacent the jointure of the teeth 46 to the blade 43. The forward and rearwardly directed surfaces of the teeth 46 are planar and parallel, the surfaces being generally tangential to the blade 43 surfaces at the edge 44. Concave arcuate side edges 49 extend between the inner and outer edges 47, 48 of each tooth 46. A wear plate 51 is attached to the forward portion of the blade 43, to the surface thereof facing to the front. A reduction gearbox 52 is attached to the rearward-facing side of the plate 39*a* and is coupled to the shaft 42.

The hopper assembly 14 includes four upright corner members 53, attached to the tube members 17*a*, 17*b*, 17*c*, 17*d* and extending upwardly therefrom. Four walls 54 are attached to, and span the space between, the members 53, thereby forming a rectangular shape open at the top and bottom. The walls 54 at their lower edges abut the upper edges of the cover doors or plates 33 and front plate 34. The interior of the hopper assembly 14 communicates with the interior of the auger assembly 13. Removable cover plates 56 are disposed in access openings 57 formed through the rear and side walls 54. A plastic curtain structure or the like (not shown) may replace a plate(s) 56 where loading of the hopper 14 is done through an access opening(s) 57. An optional lid structure 58 may be provided to close the top of the hopper assembly 14. The lid 58 is hinged to the front wall 54, and has a projecting mount 59. A support 60 is attached to the front wall 54 and supports the mount 59. An hydraulic cylinder 61 is pivotally attached to the lid mount 59 and to the center of the lid 58. Upper inside plates 62 are attached to the inside surface, and adjacent the upper edges, of the side walls 54. The plates 62 depend at an angle toward each other and terminate at the level of the upper edges of the access openings 57. Brace plates 62*a* extend between the side walls 54 and lower ends of the plates 62. The chute plate 39*b* extends upwardly into the hopper 14 and is attached to the rear and side walls 54. The straight side portions 28 of member 27 also extend upwardly into the hopper 14 and are attached to the front and side walls 54 below the bottom edge level of the access openings 57. Above the level of the upper edge of the support plate 39*a*, the side portions 28 extend to the rear, and the rear edges 28*a* are attached to the chute plate 39*b*.

The container assembly 16 is an elongated structure having elongated sides 16*a*, bottom 16*b* and top 16*c*. The assembly 16 has a closed end 16*d* and an end 16*e* having an opening 64 formed therethrough. The container assembly 16 is positionable such that the annular member 37 fits into the opening 64, the assembly 16 resting against the bumpers 23*a*, 23*b*. Ratchet devices (not shown) extending between braces 24*a*, 24*b* and the container 16 may be employed to hold the container 16 against the frame support 12.

A tank or reservoir 66 for hydraulic fluid is disposed within the support assembly 12, being mounted upon the left intermediate support 26*b* and attached to the left tube brace 21*d*. The reservoir 66 is coupled by an hydraulic line through a filter or strainer 67 to a variable displacement, noncompensated, unidirectional hydraulic pump 68. An electric motor 69 is mounted on the right support tube 26*a*, and right side brace 21*c*. A coupling 71 joins the motor 69 to the pump 68.

The pump 68 is connected through a pressure indicator 72, a pressure relief valve 73 and a filter 74 back to the reservoir 66. There is a parallel connection of the pump 68, through a four way valve 76 to a fixed displacement, bidirectional hydraulic motor 77, and back through the valve 76 and filter 74 to the reservoir 66. The valve 76 is spring centered to an "off" position and is solenoid actuated to permit flow to the motor 77. The shaft of the motor 77 is coupled to the gearbox 52.

The pump 68 is also connected, through another spring centered, solenoid actuated valve 78, to the double-acting, single end rod hydraulic cylinder 61. Flow control valves 79, adjustable with a bypass, are disposed in the lines to the cylinder 61; and flow bypasses to, and is controlled going away from, the cylinder 61. A check valve 81 is disposed in the line from the valve 78 to the port in the cylinder 61 for fluid inflow which causes the rod to retract into the cylinder. The valve 81 permits flow to the cylinder 61.

A pressure switch 82 is connected to the hydraulic line from the pump 68 before the line branches to the two valves 76, 78. The switch 82 is coupled to electric dejamming and shut-down circuitry described below. The hydraulic circuitry is disposed within the frame support assembly and is principally mounted above the tank 66.

The pallet auger 11 is generally constructed of steel tubing and plates, cut and formed according to well known methods. A hardened steel is employed for the wear plate 51. The components of the pallet auger 11 are joined together by welds, bolts and other standard methods of joining metal pieces. The components of the hydraulic system, and also of the electrical circuitry, are coupled by well known techniques.

Figure 9:
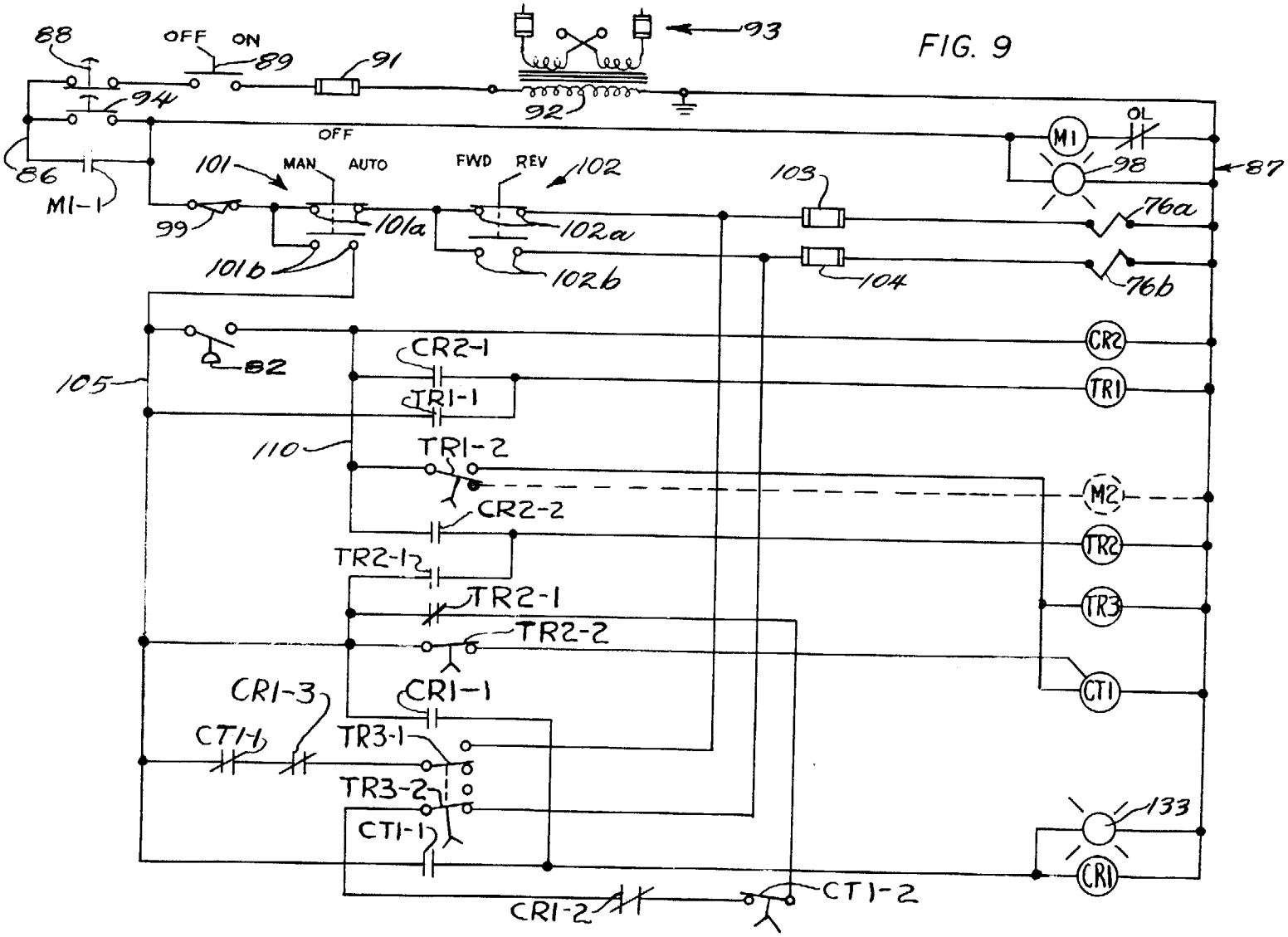
FIG. 9 is a diagram of the electric control circuit.

The electrical control circuitry is shown in FIG. 9. Primary electrical conductors are shown at 86, 87, the former being at supply, and the latter at ground, voltages. A first circuit includes a normally closed pushbutton switch 88, a keylock switch 89, a fuse 91 and one coil of a transformer 92 connected in series between conductors 86, 87. The transformer 92 is connected to a circuit 93, only partially shown, for the hydraulic pump motor 69.

A normally-open pushbutton switch 94 and a circuit closing contact M1-1 are connected in parallel, and both are connected through relay coil M1 to connector 87. A green "power on" indicator light 98 is connected in parallel with the coil M1. The switch 94 and contact M1-1 also are connected in series with a normally closed, directly actuated, spring returned limit switch 99 which is operated by the lid 58.

The switch 99 is connected to one side of a three position switch 101, having an "off" position, manual circuit contacts 101*a*, and automatic circuit contacts 101*b*. The manual circuit contacts 101*a* are connected to one side of a two circuit switch 102 having reverse mode contacts 102*a* and forward mode contacts 102*b*. Contacts 102*a* are connected by a fuse 103 through reverse solenoid 76*a* of valve 76 to conductor 87. Contacts 102*b* are connected by fuse 104 through forward solenoid 76*b* of valve 76 to conductor 87.

A common connection 105 extends from the contacts 101*b*, and the pressure switch 82 is connected thereto. Relay coil CR2 is connected between the switch 82 and conductor 87. Circuit closing contact CR2-1 and time delay relay coil TR1 are in series with switch 82 and are connected in parallel with relay coil CR2. Circuit closing contact TR1-1 is joined to connection 105 and between contact CR2-1 and relay coil TR1. The common connection 110 of coil CR2 and contact CR2-1 is joined to switch TR1-2 with a time delay closing feature. The switch TR1-2 in the "open" position may be connected to the relay coil M2 for an electric motor for driving an optional conveyor feed. The switch TR1-2 in the "closed" position is connected to time delay relay coil TR3 and to counter relay coil CT1. Another circuit closing contact CR2-2 is connected between junction 110 and relay coil TR2.

A circuit closing contact TR2-1 is connected between conductor 105 and coil TR2. Circuit opening contact TR2-1 also is connected to conductor 105. Normally closed switch TR2-2 with a time delay opening feature is connected between conductor 105 and coil CT1. Conductor 105 is also connected to circuit closing contact CR1-1.

There is a two pole, two position switch TR3-1, TR3-2 having a time delay feature. Circuit opening contacts CT1-1 and CR1-3 are connected in series between conductor 105 and switch pole TR3-1. Switch TR3-1 has an "open" normal position and in the time delay position is connected between the contacts 102*a* and fuse 103. Switch TR3-2 in the normal position closes a connection from between contacts 102*b* and fuse 104, through circuit opening contact CR1-2 and contact CT1-2 with time delay opening to contact TR2-1. Conductor 105 is connected through circuit opening contact CT1-1 to contact CR1-1 and also to relay coil CR1. A red indicator light 133 is connected in parallel with coil CR1.

To operate the pallet auger 11, the electric motor 69 is actuated to drive the pump 68. While the valves 76, 78 are "off," and also when there is an overload on the system, the fluid circulates through the valve 73. The valve 76 is actuated to permit flow to the motor 77, which then drives the gearbox 52 and shaft 42. When viewed from the front, rotation in a clockwise direction of the shaft 42 and screw 43 illustrated causes material to be driven from the rear to the front.

Wood dunnage, such as discarded wooden pallets and the like, are loaded into the hopper assembly 14. Loading may be done by hand, by conveyor belt or by dumper. Loading may be through the door-covered access openings 57 or through the top of the hopper 14. Actuation of valve 78 to the left "open" position causes flow to the cylinder 62 such that the rod retracts into the cylinder 62. The lid structure 58 pivots upwardly to permit access to the hopper 14. Actuation of the valve 78 to the right "open" position reverses flow to the cylinder 62, causing the rod to extend, thereby moving the lid 58 to the closed position.

The wood dunnage travels from the hopper 14 downwardly to the frame support assembly 12, into the space defined by the curved plate member 27 and the support plate 39*a*. The screw blade 43 engages the wood dunnage, and the teeth 46 tear at the dunnage. Rotation of the screw blade 43 causes the dunnage to move forward, and past the breaker bars 31 in the bottom portion 29. The bars 31 support the dunnage such that the screw blade 43 and teeth 46 can better engage the dunnage; and the bars 31 also tear at the dunnage. The passage of the teeth 46 through the gaps 32 facilitates tearing of the dunnage. Movement past the breaker bars 38 causes more pulverization of the dunnage. The blade 43 pushes the dunnage through the front aperture 36, annular menmber 37 and opening 64.

Prior to actuation of the pallet auger 11, the member 37 has been selected from several members 37 of the rim assembly, each having a different length. With a longer length member 37, pulverization of the dunnage results in relatively finer pieces; whereas, a shorter length member 37 causes pulverization to relatively larger pieces.

The pulverized and compacted dunnage is collected in the container assembly 16. The container 16 may be transported when it has been filled.

Should the dunnage and auger member 41 become jammed, the pressure switch 82 causes the electrical circuit to operate the valve 76 to reverse the flow to the motor 77, thereby causing the shaft 42 and blade 43 to rotate in the opposite direction. The valve 76 is then actuated by the electric circuit to cause the motor 77 to drive the shaft 42 and blade 43 in the forward direction again. This operation tends to loosen and unjam the dunnage. Should the jamming condition persist, the electric circuit causes the valve 76 to move to the "off" position, and the electric motor 69 to shut down, to permit employment of other methods for dejamming the pallet auger 11. A counter is provided in the electric circuit such that the number of times the motor 77 will be reversed as aforesaid may be preselected.

The operation of the electrical control circuit to achieve the foregoing will now be explained in greater detail. The keylock switch 89 is turned "on" thereby providing stepped-up voltage to the motor circuit 93. The normally open switch 94 is depressed, energizing the hydraulic pump motor 69 relay coil M1. Contact M1-1 is closed to keep the coil M1 energized, and the green "power on" light 98 turns on.

If the top door 58 is in the proper position, switch 99 remains closed. Switch 101 is operated to connect contacts 101*a* for the manual mode or contacts 101*b* for the automatic mode. If the manual mode is selected, switch 102 is operated to connect contacts 102*a*, thereby energizing coil 76*a* to cause valve 76 to direct fluid through motor 77 such that the screw blade 43 is driven in a "forward" rotation. Alternatively, the switch 102 connects contacts 102*b*, energizing coil 76*b*, and causing valve 76 to direct fluid through motor 77 in the opposite direction, thereby imparting a "reverse" rotation to screw blade 43.

If the automatic mode is selected at switch 101, counter CT1 is energized through conductor 105 and switch TR2-2. The coil 76*b* for forward rotation of the screw blade 43 is energized through conductor 105, normally closed contact TR2-1, switch CT1-2, contact CR1-2 and switch TR3-2.

If pressure builds up beyond a selected value in the hydraulic control circuit, the switch 82 closes, initiating the dejamming sequence. Relay coil CR2 is energized causing contacts CR2-1 and CR2-2 to close. Relay coils TR1 and TR2 are energized. Coil TR1 has a time delay feature, which is preferably set at 30 seconds, and controls the maximum time the dejamming sequence will operate. Coil TR2 also has a time delay feature, set preferably at 4 seconds. When coil TR1 is energized, contact TR1-1 closes to provide current to coil TR1, and contact TR1-2 moves to complete a circuit, energizing relay coil TR3 and sending a current signal to the counter CT1. When coil TR2 is energized, contact TR2-1 closes to provide current to coil TR2. A second contact TR2-1 opens, cutting current to solenoid 76*b* and stopping forward rotation of the screw blade 43. Contact TR2-2 opens, cutting current to one input of counter CT1.

Coil TR3 has a time delay feature, preferably set at 4 seconds, and controls the forward-reverse switching of the dejamming sequence. When coil TR3 is energized, contact TR3-1 closes a circuit to solenoid 76*a* thereby causing reverse rotation of screw blade 43. Contact TR3-2 opens, placing a second break in the line to solenoid 76*b*.

After 4 seconds, contact TR2-2 closes, sending current to counter CT1, and there is a count "one." Contact TR3-1 opens, and solenoid 76*a* deenergizes, stopping reverse rotation of blade 43. Contacts TR3-2 and TR2-1 close to energize solenoid 76*b*, starting forward rotation of blade 43. Contact TR2-1 opens, and coil TR2 is deenergized.

If the switch 82 is still closed, coil CR2 is still energized, and coil TR2 energizes. The circuit operates as before to cause a 4 second reverse rotation of blade 43 and a count of "two" by the counter CT1. If the pressure in the hydraulic circuit has reduced, switch 82 opens, deenergizing coils CR2 and TR3. Contacts CR2-1 and CR2-2 open. When the 30 second time period has elapsed, switch TR1-2 opens, contact TR1-1 opens, and coil TR1 is shut down. The current signal to the counter CT1 resets the counter CT1 at "zero." As coil TR3 is deenergized, contacts TR3-1 and TR3-2 remain in the normal position, forward solenoid 76*b* being energized.

If the counter CT1 reaches a preselected number of counts, preferably "three," within the 30 second period of coil TR1, a coil therein causes contact CT1-2 to open for a timed period, breaking the line to forward solenoid 76*b*. A first contact CT1-1 opens, breaking the line to reverse solenoid 76*a*. A second contact CT1-1 closes, energizing the "jammed" control relay CR1. Contact CR1-1 is closed to provide current to coil CR1, and the red "jammed" warning light 133 comes on. Contacts CR1-2 and CR1-3 open, and the lines to solenoids 76*a*, 76*b* are held open, even after contact CT1-2 closes again. The auger member 41 is now shut down to permit employment of other methods of dejamming.

In emergency situations, the entire circuit may be shut down by opening switch 88.

Industrial Applicability

It can be seen that waste materials, such as wood dunnage, are efficiently handled by the pallet auger 11, the interaction of the rim assembly 37, screw blade 43, teeth 46, plate member 27 and breaker bars 31, 38 being very effective. Need for landfill sites for dumping refuse is lessened, and energy and transportation costs for waste removal are lessened. The pulverized and compacted dunnage can be used as a fuel, thereby conserving energy and cutting energy costs. The relatively low rotational speeds employed and the use of hardened, replaceable parts at points of greatest wear, result in a durable, relatively long-lived device. Also, detecting pressure build-up in the hydraulic circuit is more rapid and precise than detecting amperage buildup in the electric motor and more effective in preventing wear to the device.

Although a preferred embodiment has been disclosed herein, it is to be remembered that various modifications and alternate constructions can be made without departing from the full scope of the invention, as defined in the appended claims.

I claim:

1. A machine for handling and reducing waste and like material, having a material-receiving hopper discharge downwardly into an elongated trough in which an auger rotates to move received material axially lengthwise of the trough and including means cooperative between the auger and the trough to reduce material as it is moved, characterized in that the trough has an elongated imperforate bottom of substantially semicircular section and opposite sides adjoining the bottom and flaring upwardly and outwardly to lead material directly downwardly from the hopper into the auger and trough substantially throughout the length of the trough, the trough has axially spaced apart generally upright front and rear walls and the front wall has a circular opening therein through which reduced waste is forced by the auger, the trough is larger at its rear end than at its front end so that the bottom inclines upwardly and forwardly from rear to front, the auger is generally coextensive in length with the trough and rotates on an axis coaxial with the center of the front wall opening, said axis inclining downwardly from front to rear and said auger having flighting tapering from a larger end adjacent to the rear wall to a smaller end adjacent to the front wall so that a line extended from rear to front along the bottom of the flighting is substantially parallel to the bottom of the trough whereby material is moved uphill to the opening and is simultaneously compressed and tapered as it exits from the trough through the front wall opening.

2. The machine of claim 1, further characterized in that tubular extension means is selectively connectible to the front wall externally thereof as a coaxial forward extension of the front wall opening to increase the length of axial travel of the material forwardly beyond the front wall opening and thereby to further restrict and confine the materials before it exits completely from the trough.

3. The machine of claim 1, further characterized in that the means cooperative between the auger and trough for reducing material comprises a plurality of teeth on and projecting radially from the auger flighting and a plurality of breaker bars fixed to and projecting upwardly from the trough bottom and spaced apart both lengthwise and semi-circumferentially of the trough bottom in such manner that the auger teeth pass between the bars with a cutting and breaking action of the material.

4. The machine of claim 1, further characterized in that said auger means has forward, reverse and off modes of operation and includes first means for detecting and signaling a jamming condition and second means for switching said auger means between said forward, reverse and off modes, said second means being coupled to said first means and being operable in response to said first means' signaling, and said second means includes first timing means for setting a maximum duration, second timing means for switching said auger means between said forward and reverse modes, and counting means for switching said auger means to said off mode, said first and second timing means and said counting means being connected to, and actuated by signaling of, said first means, said counting means being connected to both said first and second timing means, said first timing means being operable to signal said counting means when said duration has expired, said second timing means being operable to continuously switch said auger means between said forward and reverse modes as long as said first means is signaling and being operable to signal each switch to said counting means, said counting means being operable to shut off said auger means upon receiving preselected number of said second timing means' signals before receiving said first timing means' signal.

* * * * *

UNITED STATES PATENT AND TRADEMARK OFFICE

CERTIFICATE OF CORRECTION

PATENT NO. : B1 4,253,615

DATED : August 15, 1989

INVENTOR(S) : Larry E. Koenig

It is certified that error appears in the above-identified patent and that said Letters Patent is hereby corrected as shown below:

Column 1, lines 32 - 54, the passage beginning "the trough has . . ." and ending with "from the trough through the front wall opening" should not be italicized; and In Column 1, line 55, the phrase--the means cooperative between the auger and trough for--should be inserted before "reducing"

Signed and Sealed this

Nineteenth Day of November, 1991

*Attest:*

HARRY F. MANBECK, JR.

*Attesting Officer*

*Commissioner of Patents and Trademarks*

241-36 SR

CCCI3 OR 4,253,615

REEXAMINATION CERTIFICATE (1115th)

United States Patent [19]

Koenig

[11] B1 4,253,615

[45] Certificate Issued Aug. 15, 1989

[54] PALLET AUGER

[76] Inventor: Larry E. Koenig, 1208 Medow Lane Dr., Bettendorf, Iowa 52722

Reexamination Request:
No. 90/001,615, Oct. 6, 1988

Reexamination Certificate for:

| | |
|---|---|
| Patent No.: | **4,253,615** |
| Issued: | **Mar. 3, 1981** |
| Appl. No.: | **72,715** |
| Filed: | **Sep. 4, 1979** |

[51] Int. Cl.[4] ..... B02C 18/38
[52] U.S. Cl. ..... 241/36; 241/260.1
[58] Field of Search ..... 241/260.1; 414/526

[56] References Cited

U.S. PATENT DOCUMENTS

| | | | |
|---|---|---|---|
| 14,901 | 5/1865 | Brecht | 414/408 |
| Re. 16,713 | 8/1927 | Holland-Letz | 241/157 |
| 31,098 | 1/1861 | Miles . | |
| 469,097 | 2/1892 | Seaberg | 241/260.1 |
| 985,480 | 2/1911 | Wallis | 110/10 |
| 1,298,289 | 3/1919 | Byrd . | |
| 1,724,593 | 8/1929 | Hunt . | |
| 2,307,692 | 1/1943 | Linde | 414/526 |
| 2,468,613 | 4/1949 | Bjorklund | 241/41 |
| 2,985,211 | 5/1961 | Letz . | |
| 3,059,791 | 10/1962 | Stratton | 414/526 |
| 4,040,571 | 8/1977 | Lindeborg | 241/36 X |
| 4,182,592 | 1/1980 | Henryson | 241/260.1 X |
| 4,227,849 | 10/1980 | Worthington | 414/408 |

FOREIGN PATENT DOCUMENTS

| | | | |
|---|---|---|---|
| 560070 | 3/1975 | Switzerland | 241/160.1 |

OTHER PUBLICATIONS

*Operation Maintenance and Parts Manual Product Gruncher Model "A"*, Wayne Engineering Corp., Cedar Falls, Iowa, published prior to Sep. 4, 1978.

*Gruncher A New Era,* Wayne Engineering Corp., Cedar Falls, Iowa; published prior to Sep. 4, 1978.

*Primary Examiner*—Mark Rosenbaum

[57] ABSTRACT

In machines for handling waste material, a particular problem is effective pulverization and compacting of larger materials. A hopper (14) is mounted upon a frame (12) containing an auger (13). The frame (12) has a curved bottom (29) and an opening (36). An adjustable rim assembly (37) is disposed about the opening (36). The auger blade (43) has peripheral teeth (46). Breaker bar structures (31, 38) are disposed on the bottom (29) and about the opening (36). Interaction of the blade and teeth, breaker bars and rim cause efficient pulverization of larger waste materials.

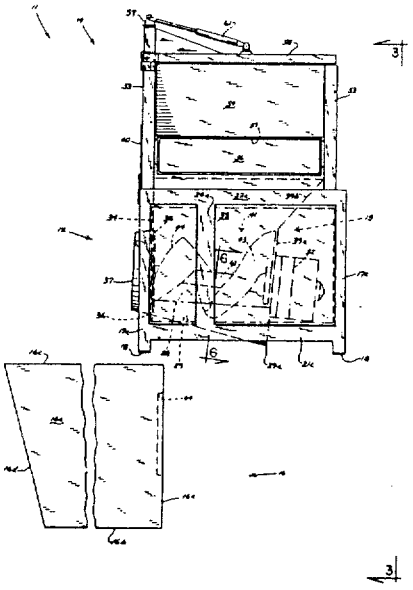

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2 and 3 are cancelled.

Claims 1 and 4 are determined to be patentable as amended.

New claim 5 is added and determined to be patentable.

1. A machine for handling and reducing waste and like material, having a material-receiving hopper discharge downwardly into an elongated trough in which an auger rotates to move received material axially lengthwise of the trough and including means cooperative between the auger and the trough to reduce material as it is moved, characterized in that:

*the trough has an elongated imperforate bottom of substantially semicircular section and opposite sides adjoining the bottom and flaring upwardly and outwardly to lead material directly downwardly from the hopper into the auger and trough substantially throughout the length of the trough, the trough has axially spaced apart generally upright front and rear walls and the front wall has a circular opening therein through which reduced waste is forced by the auger, the trough is larger at its rear end than at its front end so that the bottom inclines upwardly and forwardly from rear to front, the auger is generally coextensive in length with the trough and rotates on an axis coaxial with the center of the front wall opening, said axis inclining downwardly from front to rear and said auger having flighting tapering from a larger end adjacent to the rear wall to a smaller end adjacent to the front wall so that a line extended from rear to front along the bottom of the flighting is substantially parallel to the bottom of the trough whereby material is moved uphill to the opening and is simultaneously compressed and tapered as it exits from the trough through the front wall opening, and reducing material comprises a plurality of teeth on and projecting radially from the auger flighting and a plurality of breaker bars fixed to and projecting upwardly from the trough bottom and spaced apart both lengthwise and semi-circumferentially of the trough bottom in such manner that the auger teeth pass between the bars with the cutting and breaking action of the material.*

4. [The machine of claim 1, further characterised in that] *A machine for handling and reducing waste and like material, having a material-receiving hopper discharge downwardly into an elongated trough in which an auger rotates to move received material axially lengthwise of the trough and including means cooperative between the auger and the trough to reduce material as it is moved, characterized in that:*

*the trough has an elongated imperforate bottom of substantially semicircular section and opposite sides adjoining the bottom and flaring upwardly and outwardly to lead material directly downwardly from the hopper into the auger and trough substantially throughout the length of the trough,*

*the trough has axially spaced apart generally upright front and rear walls and the front wall has a circular opening therein through which reduced waste is forced by the auger,*

*the trough is larger at its rear end than at its front end so that the bottom inclines upwardly and forwardly from rear to front,*

*the auger is generally coextensive in length with the trough and rotates on an axia coaxial with the center of the front wall opening,*

*said axis inclining downwardly from front to rear and said auger having flighting tapering from a larger end adjacent to the front wall so that a line extended from rear to front along the bottom of the flighting is substantially parallel to the bottom of the trough whereby material is moved uphill to the opening and is simultaneously compressed and tapered as it exits from the trough through the front wall opening, and* said auger means has forward, reverse and off modes of operation and includes first means for detecting and signalling a jamming condition and second means for switching said auger means between said forward, reverse and off modes, said second means being coupled to said first means and being operable in response to said first means' signaling, and said second means includes first timing means for setting a maximum duration, second timing means for switching said auger means between said forward and reverse modes, and counting means for switching said auger means to said off mode, said first and second timing means and said counting means being connected to, and actuated by signaling of, said first means, said counting means being connected to both said first and second timing means, said first timing means being operable to signal said counting means when said duration has expired, said second timing means being operable to continuously switch said auger means between said forward and reverse modes as long as said first means is signaling and being operable to signal each switch to said counting means, said counting means being operable to shut off said auger means upon receiving preselected number of said second timing means' signals before receiving said first timing means' signal.

*5. A machine for handling and reducing waste and like material, having a material-receiving hopper discharge downwardly into an elongated trough in which an auger rotates to move received material axially lengthwise of the trough and including means cooperative between the auger and the trough to reduce material as it is moved, characterized in that:*

*the trough has an elongated imperforate bottom of substantially semicircular section and opposite sides adjoining the bottom and flaring upwardly and outwardly to lead material directly downwardly from the hopper into the auger and trough substantially throughout the length of the trough,*

*the trough has axially spaced apart generally upright front and rear walls and the front wall has a circular*

*opening therein through which reduced waste is forced by the auger,*

*the trough is larger at its rear end than at its front end so that the bottom inclines upwardly and forwardly from rear to front,*

*the auger is generally coextensive in length with the trough and rotates on an axis coaxial with the center of the front wall opening, and*

*tubular extension means having a predetermined length, selected from a plurality of tubular extension means of different lengths, each connectible to the front wall externally thereof as a coaxial forward extension of the front wall opening for increasing the length of axial travel of the material forwardly beyond the front wall opening thereby restricting and confining materials and further reducing material piece size in inverse relation to said predetermined length.*

* * * * *